US005143339A

United States Patent [19]

Ashcraft et al.

[11] Patent Number: 5,143,339

[45] Date of Patent: Sep. 1, 1992

[54] SPEAKER MOUNTING ASSEMBLY

[75] Inventors: Daniel W. Ashcraft, Torrance; Steve G. Romeo, Los Angeles, both of Calif.

[73] Assignee: JBL, Incorporated, Northridge, Calif.

[21] Appl. No.: 663,151

[22] Filed: Mar. 1, 1991

[51] Int. Cl.[5] ..... B42F 13/00

[52] U.S. Cl. ..... 248/343; 248/320

[58] Field of Search ..... 248/343, 342, 320, 323, 248/327, 544, 27.3

[56] References Cited

U.S. PATENT DOCUMENTS

| | | | |
|---|---|---|---|
| 2,770,435 | 11/1956 | Becker . | |
| 2,997,575 | 8/1961 | Schwartz . | |
| 3,024,356 | 3/1962 | Florence . | |
| 3,248,535 | 4/1966 | Docimo . | |
| 3,721,817 | 3/1973 | Contratto . | |
| 3,859,480 | 1/1975 | Birkner . | |
| 3,912,865 | 10/1975 | Seebinger | 248/343 |
| 4,380,099 | 4/1983 | Dick . | |
| 4,399,497 | 8/1983 | Druffel . | |
| 4,439,643 | 3/1984 | Schweizer . | |
| 4,484,658 | 11/1984 | Grote . | |
| 4,546,850 | 10/1985 | Litner . | |
| 4,727,587 | 2/1988 | Black . | |
| 4,748,543 | 5/1988 | Swarens . | |
| 4,754,377 | 6/1988 | Wenman . | |

OTHER PUBLICATIONS

Atlas/Soundolier Consumer Products Catalog, 1988.

*Primary Examiner*—Ramon O. Ramirez

*Attorney, Agent, or Firm*—James P. Ryther

[57] ABSTRACT

A speaker moounting assembly wherein the speaker is supported on a ceiling or wall construction. The baffle associated with the speaker includes a grille face exposed on the exterior of the ceiling or wall and an opposed interior face. Brackets are supported on the interior face, and frame clips are connected to the brackets. These clips include an inwardly extending portion which provides for the attachment of a hairpin spring. A ring is located in spaced relationship with the interior face of the baffle, and openings are defined by the ring for receiving each hairpin spring. In particular, the hairpin spring includes spring arms adapted to engage opposite side edges of the ring openings with the arms being urged apart for thereby urging the baffle toward the ring. The baffle is adapted to be pulled away from the ring in opposition to the action of the spring arms for permitting access to the speaker. The openings for receiving the spring arms preferably define at least two sets of opposed side edges whereby the engagement of the spring arms can be switched between sets of openings to permit adjustment of the forces holding the baffle in position adjacent to the ring.

19 Claims, 5 Drawing Sheets

SPEAKER MOUNTING ASSEMBLY

BACKGROUND OF THE INVENTION

This invention relates to mounting means for speakers. In particular, the invention is concerned with the provision of efficient and economical means for supporting speakers on ceilings or walls.

In the construction of certain types of buildings, for example, those including auditoriums and theaters, it is often necessary to mount a large number of speakers on ceilings and walls. Wherever this occurs, there are obvious opportunities for saving substantial expense in terms of the hardware required for secure mounting, and in terms of the time and labor devoted to the mounting operation. In addition, substantial efficiencies can be achieved where the mounting system for the speakers permits ready access for maintenance and replacement reasons.

Existing mounting means for speakers are characterized by inefficient design. In particular, such mounting means, for example as shown in Grote U.S. Pat. No. 4,484,658, generally include the need for attachment of parts with screw fasteners thereby necessitating awkward and time-consuming assembly operations. Similarly, such mounting systems are not readily accessible for maintenance purposes.

Attempts have been made to simplify mounting of speakers, for example as disclosed in Schweizer U.S. Pat. No. 4,439,643. The snap-fit system described in this patent does not, however, provide significant advantages over the use of screw-type fasteners and the like, and also does not totally eliminate the need for such fasteners.

Litner U.S. Pat. No. 4,546,850 deals with a speaker and grille mounting system wherein spring clips are employed. These clips are, however, used in conjunction with threaded fasteners and do not serve to solve the problems discussed above. On the other hand, the clip mounting arrangement described in Birkner, et al. U.S. Pat. No. 3,859,480 is not suitable for construction projects wherein ceiling and wall mounting of speakers is contemplated.

SUMMARY OF THE INVENTION

This invention involves a particularly efficient combination comprising the assembly of a speaker and means for supporting a speaker on a ceiling or wall. In this assembly, the grille face of the baffle associated with the speaker is exposed on the exterior of the ceiling or wall and an opposed interior face. Brackets are supported on the interior face, and frame clips are connected to the brackets.

The frame clips extend inwardly and they define a portion which serves as a means for attaching a hairpin spring. This hairpin spring includes spring arms which normally spread outwardly and which must be forced inwardly in opposition to the spring action.

A separate ring, support brackets, or other support structure is provided in the assembly in spaced relationship with the interior face of the baffle. This support structure defines a central open area for receiving the body of the speaker while also defining separate openings dimensioned for receiving the arms of the hairpin springs. In particular, the openings defined by the support structure include opposed side edges which are adapted for engagement by the spring arms. Once the spring arms are inserted into these openings, the spring forces urge the arms into engagement with the opening side edges and thereby urge the baffle and associated speaker toward said support structure. The spring arms thus serve to hold the baffle in position adjacent to the support structure while the baffle may be pulled away from the structure in opposition to the spring action in order to provide access to the speaker for maintenance or replacement purposes.

In a preferred form of the invention, the openings defined by the support structure include at least two sets of opposed side edges. The respective sets are spaced different distances apart, that is, the opposed edges of one set will be more closely spaced than the opposed edges of another set. With this arrangement, the spring arms can be selectively engaged with a set of opposed edges whereby the force exerted by the arms against the edges can be varied. For example, where a particularly heavy speaker is to be mounted in the ceiling, it is desirable to provide a higher engaging force of the spring arms to more securely support the speaker.

The assembly of the invention may optionally include an enclosure called a "can" of the type conventionally located in surrounding relationship with the speaker for thereby protecting the speaker and for meeting fire codes. In accordance with this invention, reinforcing ribs may be formed in the can, and such ribs are located in asymmetrical fashion around the body of the can. This rib arrangement has been found to minimize resonance problems during operation of a speaker.

Other details and advantages of the assembly of the invention will be apparent from a consideration of the appended drawings and from the description of the preferred embodiments contained herein.

DETAILED DESCRIPTION OF THE DRAWINGS

Figure 2:
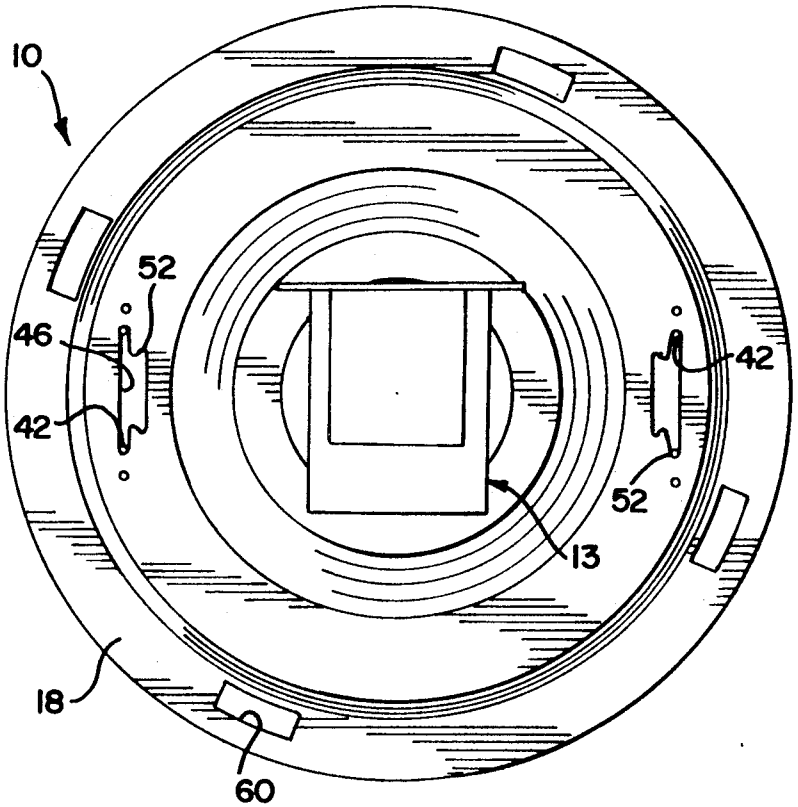
FIG. 2 is a plan view of the assembly, with the exterior can removed, taken about the line 2—2 of FIG. 1.

FIGS. 1 through 5 illustrate an assembly 10 adapted for mounting in association with ceiling panel 12. In connection with this assembly and other aspects of the invention, it will be appreciated that the mounting features are adaptable to speakers to be located on walls and other surfaces.

The assembly includes speaker 13 which includes grille face 14 exposed on the exterior of the panel 12, and associated baffle 15. As will be apparent from a further consideration of this description, speakers of various types including those with various types of baffles such as flush, domed, and recessed baffles are intended for use in association with the concepts of this invention. It will also be noted that although the invention has been illustrated in connection with circular baffles, the features of the invention are adaptable to baffles of other design including baffles with rectangular grille faces. In that same connection, the use hereinafter of terms such as "ring" as a type of support structure is for convenience and is not to be construed as limited to a circular shape.

Figure 3:
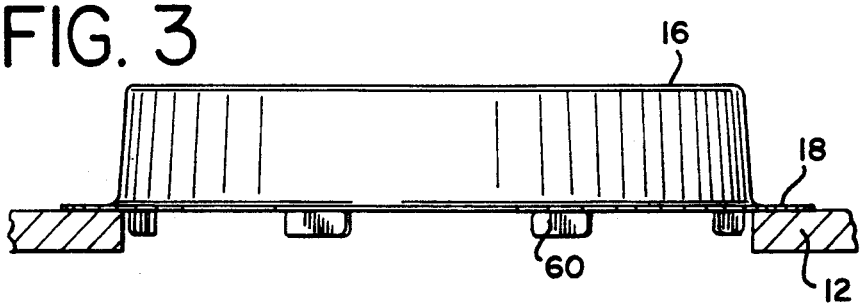
FIG. 3 is a side elevational view of the ring construction employed with the respective assemblies of the invention.

FIG. 3 illustrates a support structure in the form of ring 16 supported on the opposite face of panel 12. Thus, the ring 16 defines a peripheral rim 18 for engagement with the interior face of the panel 12. This peripheral rim, along with peripheral rim 20 defined by the grille face 14 serves to sandwich the panel in the assembly.

Figure 10:
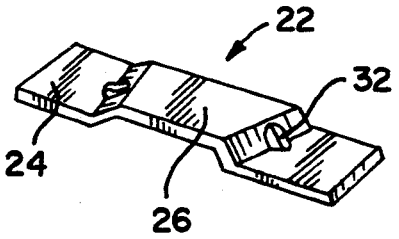
FIG. 10 is a perspective view of the mounting bracket employed conjunction with the assembly of FIG. 8.

Strap-like brackets 22 are attached to the interior face of the baffle 15. As best shown in FIG. 10, these brackets include legs 24 at each end which may be spot-welded to the face of the baffle. An intermediate upraised portion 26 serves to define an opening between the legs 24.

Frame clips 28 define first finger means 30 which are adapted to be inserted in openings 32 defined by the brackets 22. The clips each include spaced apart arms 34 which are adapted to be pressed toward each other so that the first finger means of the clips can be moved inside the brackets. Upon release of the pressure on these arms, the first finger means will enter the openings 32 for thereby securing the clips relative to the brackets. It will be noted that a degree of pivotal movement of the clips relative to the face of the baffle is permitted with this arrangement.

Clips 28 also define second finger means 36 at their opposite ends. The second finger means 36 are engageable with the coiled end 38 of hairpin spring 40. Specifically, this coiled end defines an opening which receives the finger means 36.

In the embodiment shown in FIGS. 1 through 5, a pair of hairpin springs 40 are employed. Each of these springs include a pair of arms 42 which are normally urged apart by reason of the spring action of the coiled end 38. The spring arms each define right angle bends 44 which extend outwardly in opposite directions and which serve as means for retaining the springs relative to ring 16.

The clips 28 serve not only to hold the hairpin springs 40 in place, but also serve to anchor the speaker securely to the baffle. The geometry of these spring clips 28 is multipurpose in that the force of gravity, combined with the upward pull of the hairpin spring, serves to hold the speaker more and more securely as any downward force on the baffle increases. This is because downward pressure bends the vertical part of the spring clip inwards towards the center of the baffle, and consequently forces the horizontal part 29 of the clip, located immediately above the baffle shoulder 31, downwardly.

It will also be noted in particular that ring 16 defines a pair of openings 46 in upper rim portion 48. These openings 46 preferably comprise "butterfly" openings wherein separate pairs of opposed side edges 50 and 52 are provided. In the embodiment shown, the side edges 52 are more closely spaced than the other pair of side edges 50.

Figure 5:
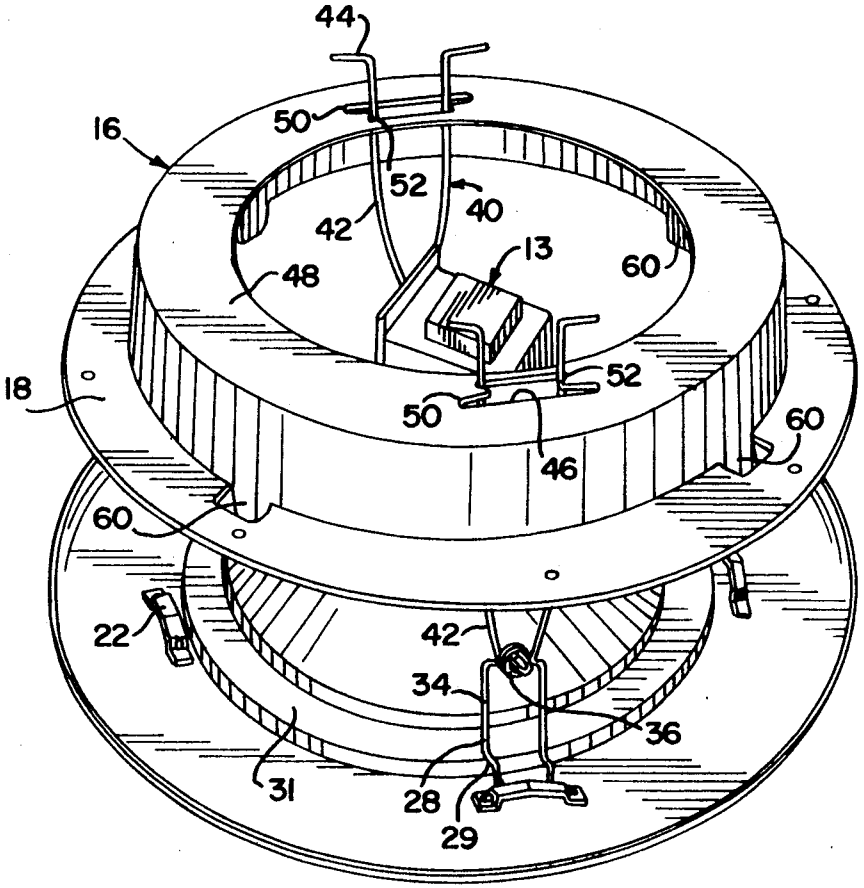
FIG. 5 is a perspective view of the assembly with the grill and associated speaker separated from the ring of the assembly.

As will be apparent from a consideration of FIG. 5, the spring arms 42 of springs 40 may be engaged with either set of opposed side edges. Where the more closely spaced pair of side edges 52 are engaged, greater spring pressure will be applied by the spring arms than would be the case where the spring arms engage the opposed side edges 50. To achieve an intermediate pressure, one spring arm could be engaged with a side edge 50 and the other spring arm with a side edge 52. This arrangement will compensate for off-center mounting of a transformer or other line-matching device on the speaker frame, or due to the presence of magnetic forces.

Figure 4:
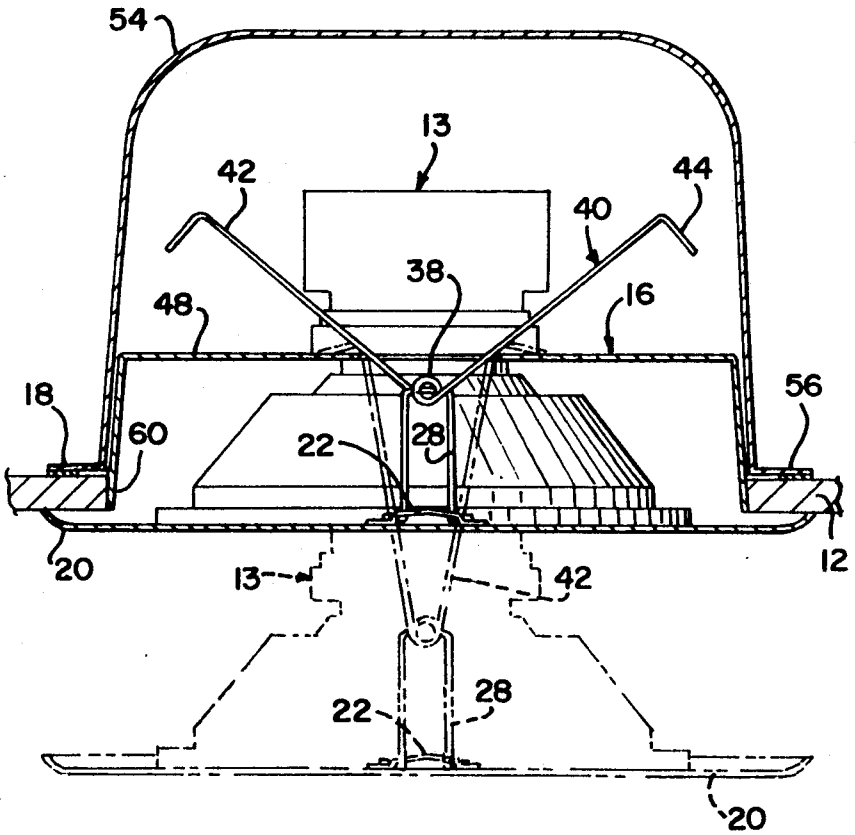
FIG. 4 is a vertical sectional view taken about the line 4—4 of FIG. 1.

As will be apparent when considering FIGS. 4 and 5, the hairpin springs 40 function to retain the baffle and speaker assembly relative to ring 16. In particular, the respective spring arms 42 operate to urge the baffle and speaker assembly toward the ring 16 thereby tightly holding the baffle against ceiling panels 12. If access to the speaker is desired for replacement, maintenance, or any other reason, the baffle and associated speaker can be readily pulled away from the ceiling panels in opposition to the action of springs 40. The spring action is such that at some "over-center" point, the forces of the spring arms against the side edges of openings 46 will be insufficient to pull the assembly of the baffle and speaker back into position. Under those circumstances, the fingers 44 at the ends of the spring arms serve to suspend the baffle and speaker assembly in spaced relationship with the ceiling panels. The fact that the speaker is a relatively heavy product enhances this ability to achieve a stable open position for the baffle thereby simplifying maintenance or other operations.

Figure 1:
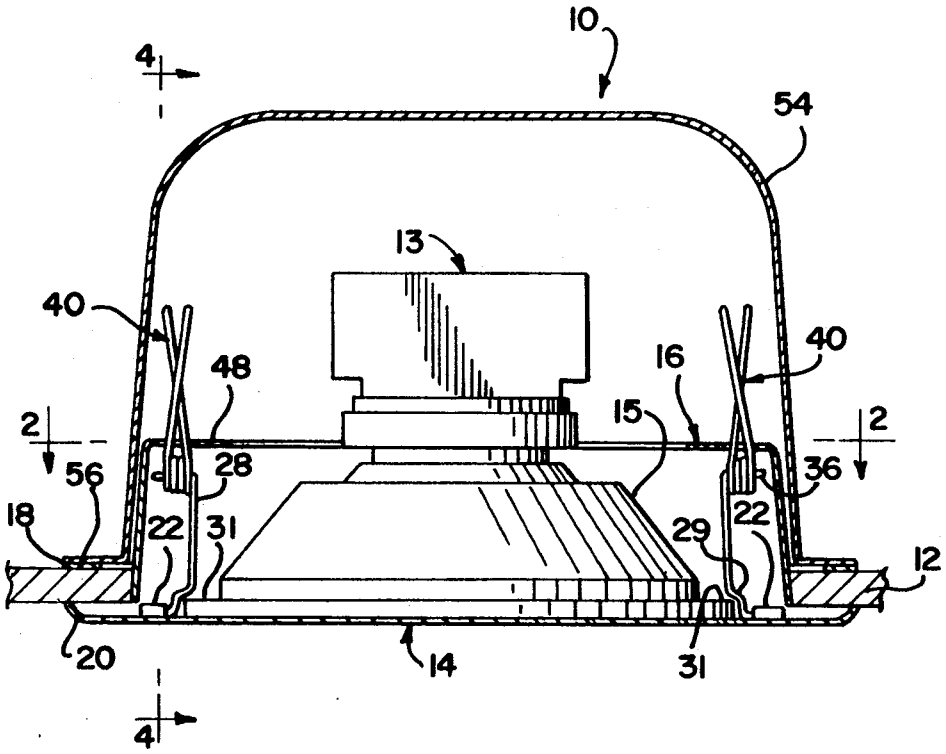
FIG. 1 is a vertical, sectional view of a speaker and mounting assembly in accordance with the invention.

FIGS. 1 and 4 illustrate can 54 which may be used for enclosing the speaker in order to comply with building codes. This can includes an outwardly extending peripheral flange 56 which may be attached to flange 58 of ring 16. The ring 16 also includes downwardly extending tabs 60 which are received in an opening defined by ceiling panels 12 and which are positioned adjacent the edges of the opening for thereby holding the mounting assembly in position relative to such opening.

Figure 6:
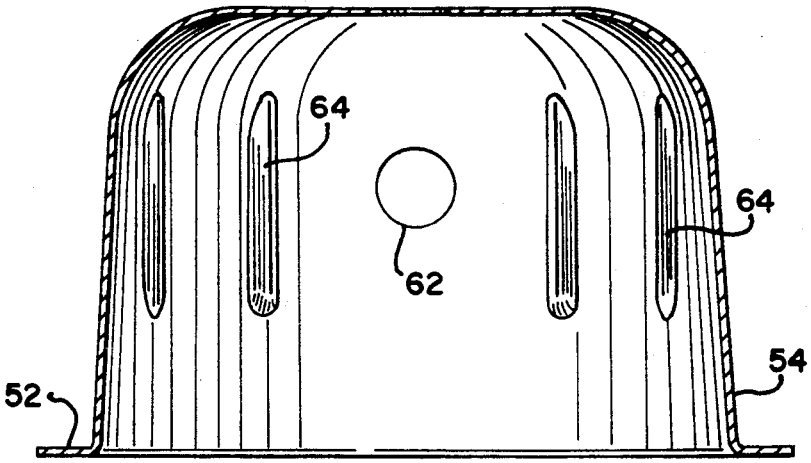
FIG. 6 is a vertical sectional view of a preferred form of can design.
Figure 7:
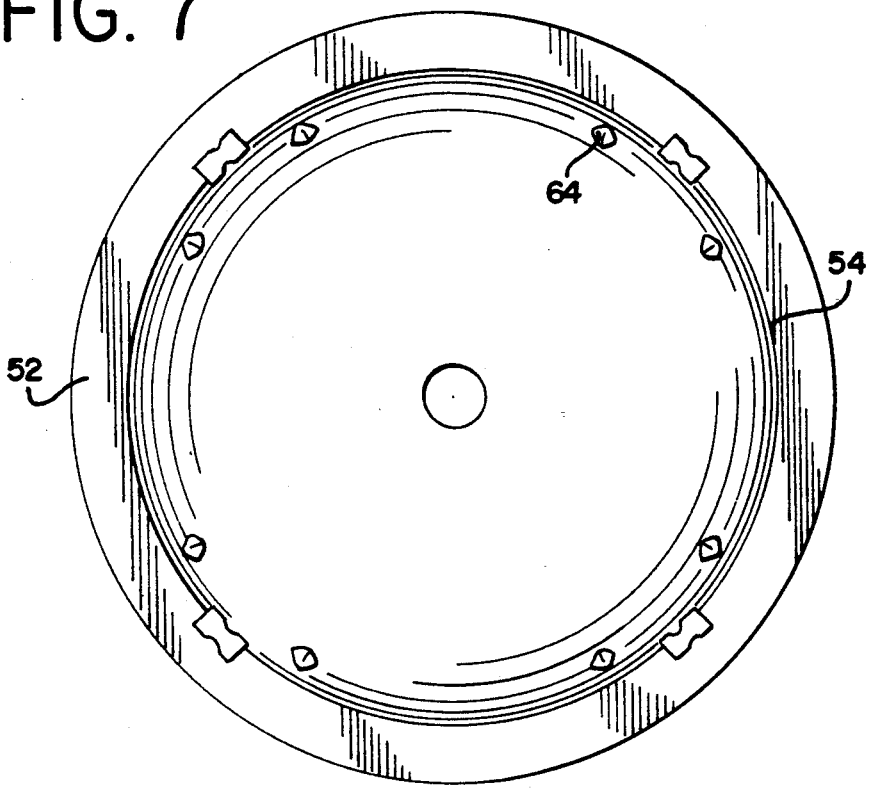
FIG. 7 is a bottom plan view of the can shown in FIG. 6.

FIGS. 6 and 7 illustrate a preferred form for can 60. In addition to one or more openings such as opening 62 which are included for wiring purposes, this can defines a plurality of ribs 64. The ribs serve as reinforcing means for strengthening the can; however, they are also asymmetrically positioned over the can surface to minimize resonance which might otherwise develop during the speaker operation.

Figure 8:
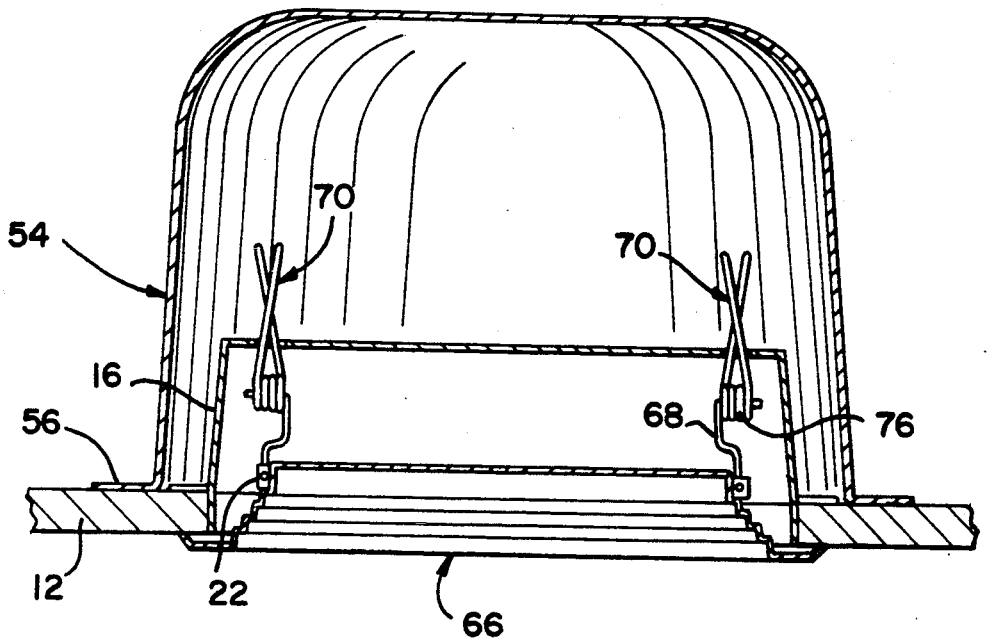
FIG. 8 is a vertical sectional view of an alternative form of the invention utilizing a recessed grill.
Figure 9:
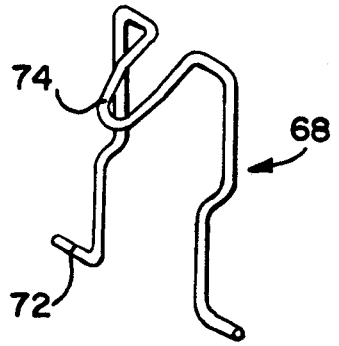
FIG. 9 is a perspective view of a clip employed in conjunction with the assembly of FIG. 8.

FIGS. 8 through 10 illustrate features of an alternative form of the invention. In this case, a can 54 and ring 16 are also illustrated with the assembly being positioned in an opening defined by ceiling panels 12. A baffle 66 of the recessed type is connected to the ring by means of clips 68 and hairpin springs 70. Brackets 22 are, in this case, mounted on a side wall of the interior face of the baffle with the frame clips 66 defining feet 72 for receipt within the openings 32 of the brackets. Second finger means 74 of the frame clips are received by the coil end 76 of hairpin springs 70.

It will be appreciated from a consideration of the embodiment shown in FIGS. 8 through 10 that baffles of various designs may be utilized in connection with the mounting means of this invention. In each such instance, the provision of the brackets and frame clips on the baffle can be accomplished very quickly when compared with assembly operations which require threaded fasteners. Similarly, the inclusion of hairpin springs in the assembly and the insertion of these springs relative to the ring structure involves a simple and quick assembly operation. When these features are considered in conjunction with the ready and convenient access which is achievable for maintenance and similar purposes, the clear advantages of the invention become apparent.

Figure 11:
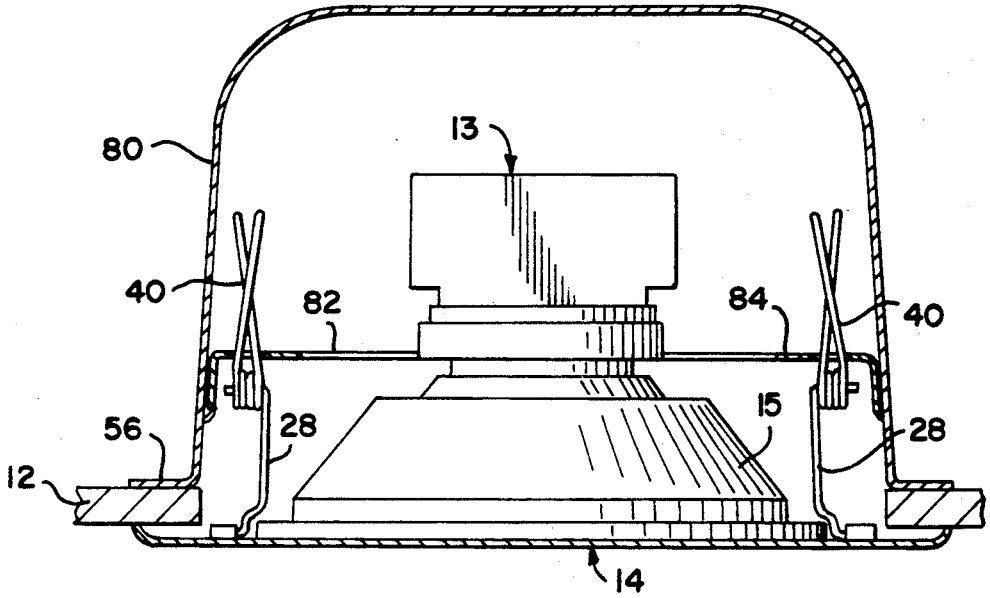
FIG. 11 is a vertical sectional view of another alternative form of the invention.

FIG. 11 illustrates an additional variation of the invention wherein the can 80 is provided with a ring 82 which is welded or otherwise attached onto the interior face of the can. Openings, such as openings 46 shown in FIG. 2 are formed in rim 84 for receiving springs 40.

Figure 12:
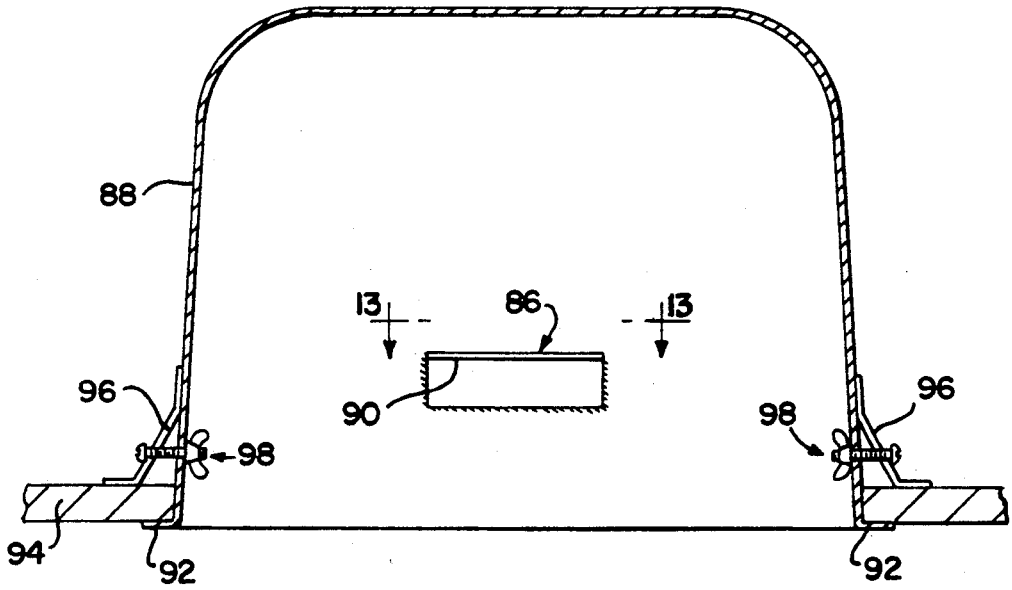
FIG. 12 is a vertical sectional view of a further alternative form of the invention; and, FIG. 13 is a fragmentary, cross-sectional view illustrating the bracket of FIG. 12.
Figure 13:
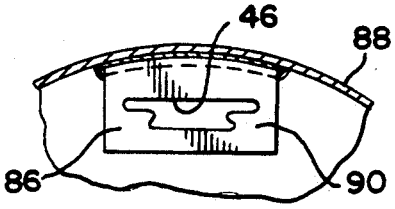

In the embodiment of FIGS. 12 and 13, a single bracket 86 is welded to the interior side wall of the can 88 to provide a support structure as opposed to a complete ring. The horizontal portion 90 of the bracket is employed for defining an opening 46 or an opening of any other suitable shape. One or more additional brackets are then attached at other locations on the can wall.

FIG. 12 also illustrates a variation wherein the flange portion 92 of the can 88 extends to the exterior side of ceiling or wall panel 94. Angle brackets 96 and threaded fasteners 98 are then employed for holding the can in position relative to the panel.

It will be understood that various additional changes and modifications may be made in the embodiments of the invention described herein without departing from the spirit of this invention, particularly as defined in the following claims.

That which is claimed is:

1. An assembly including a speaker, a ceiling or wall, and means for supporting the speaker on the ceiling or wall comprising a baffle associated with said speaker, said baffle having a grille face exposed on the exterior of said ceiling or wall and an opposed interior face, brackets supported on said interior face, inwardly extending frame clips connected to said brackets, springs connected to at least some of said clips, a support structure located in spaced relationship with said interior face, openings defined by said support structure for receiving said springs, said springs each including spring arms adapted to engage opposite side edges of said openings, said arms being urged apart and thereby urging said interior face toward said support structure, said interior face being adapted to be pulled away from said support structure in opposition to the action of said spring arms to permit access to said speaker, and including a protective can mounted around said speaker and support structure, said support structure including means for attachment of said can.

2. An assembly according to claim 1 wherein said springs comprise hairpin springs and including retaining fingers defined at the ends of said spring arms to limit the distance that said interior face may be pulled away from said ring.

3. An assembly according to claim 1 wherein said support structure comprises a ring defining a central opening receiving said speaker.

4. An assembly according to claim 3 wherein said ring defines an outwardly extending peripheral flange portion overlying the interior surface of the ceiling or wall supporting the assembly.

5. An assembly according to claim 4 wherein said baffle includes a peripheral flange portion overlying the exterior surface of the ceiling or wall supporting the assembly.

6. An assembly accordingly to claim 1 wherein said can defines a wall surrounding said speaker, and including ribs formed in said wall, said ribs being asymmetrically located in said wall for thereby minimizing resonance.

7. An assembly according to claim 1 wherein said support structure comprises brackets attached to the interior face of said can.

8. An assembly according to claim 7 wherein said can defines an outwardly extending peripheral flange overlying the interior surface of the ceiling or wall supporting the assembly.

9. An assembly according to claim 8 wherein said baffle includes a peripheral flange portion overlying the exterior surface of the ceiling or wall supporting the assembly.

10. An assembly according to claim 1 wherein said can outwardly extending peripheral flange overlying the exterior surface of the ceiling or wall supporting the assembly, and including means associated with said can in engagement with the interior surface of said ceiling or wall for securing the can in position.

11. An assembly including a speaker, a ceiling or wall, and means for supporting the speaker on the ceiling or wall comprising a baffle associated with said speaker, said baffle having a grille face exposed on the exterior of said ceiling or wall and an opposed interior face, brackets supported on said interior face, inwardly extending frame clips connected to said brackets, springs connected to at least some of said clips, a support structure located in spaced relationship with said interior face, openings defined by said support structure for receiving said springs, said springs each including spring arms adapted to engage opposite side edges of said openings, said arms being urged apart and thereby urging said interior face toward said support structure, said interior face being adapted to be pulled away from said support structure in opposition to the action of said spring arms to permit access to said speaker, and wherein said brackets comprise strap-like means attached to said interior face, said clips defining first finger means insertable relative to said strap-like means, said springs defining openings at the base thereof, and second finger means defined by said clips insertable into said spring openings for connecting of said clips and springs.

12. An assembly according to claim 11 including openings defined by said strap-like means, said first finger means being insertable in said openings of said strap-like means for securing of said clips to said strap-like means.

13. An assembly according to claim 12 wherein said clips are formed of resilient material and define a pair of opposed arms extending between the respective finger means, said arms being pressed together to permit insertion of said first finger means into said openings defined by said strap-like means whereby said clips are resiliently held in place upon release of said arms.

14. An assembly according to claim 11 including a stepped area defined by said speaker, said clips defining intermediate shoulder portions engageable with said stepped area.

15. An assembly including a speaker, a ceiling or wall, and means for supporting the speaker on the ceiling or wall comprising a baffle associated with said speaker, said baffle having a grille face exposed on the exterior of said ceiling or wall and an opposed interior face, brackets supported on said interior face, inwardly extending frame clips connected to said brackets, springs connected to at least some of said clips, a support structure located in spaced relationship with said interior face, openings defined by said support structure for receiving said springs, said springs each including spring arms adapted to engage opposite side edges of said openings, said arms being urged apart and thereby urging said interior face toward said support structure, said interior face being adapted to be pulled away from said support structure in opposition to the action of said spring arms to permit access to said speaker, and wherein said openings defined by said support structure comprise at least two sets of opposed side edges, one set of side edges being more closely spaced apart than the other whereby the force required for pulling said interior face away from said ring will vary depending upon which set of opposed side edges is engaged by said spring arms.

16. An assembly according to claim 15 wherein said openings defined by said support structure each consist of a single opening having said two sets of opposed side edges whereby the engagement of the spring arms can be switched between sets of openings depending upon whether greater or lesser pulling force is desired.

17. An assembly including a speaker, a ceiling or wall, and means for supporting the speaker on the ceiling or wall comprising a baffle associated with said speaker, said baffle having a grille face exposed on the exterior of said ceiling or wall and an opposed interior face, brackets supported on said interior face, inwardly extending frame clips connected to said brackets, springs connected to at least some of said clips, a support structure located in spaced relationship with said interior face, openings defined by said support structure for receiving said springs, said springs each including spring arms adapted to engage opposite side edges of said openings, said arms being urged apart and thereby urging said interior face toward said support structure, said interior face being adapted to be pulled away from said support structure in opposition to the action of said spring arms to permit access to said speaker, and wherein said one face of said baffle is recessed relative to the surface of said ceiling or wall.

18. An assembly according to claim 17 wherein said brackets comprise strap-like means, a stepped side wall structure extending away from said interior face of said baffle, said bracket being attached to said side wall, said clips defining first finger means insertable relative to said strap-like means, said springs comprising hairpin springs defining openings at the base thereof, and second finger means defined by said clips insertable into said spring openings for connecting of said clips and springs.

19. An assembly including a speaker, a ceiling or wall, and means for supporting the speaker on the ceiling or wall comprising a baffle associated with said speaker, said baffle having a grille face exposed on the exterior of said ceiling or wall and an opposed interior face, brackets supported on said interior face, inwardly extending frame clips connected to said brackets, springs connected to at least some of said clips, a support structure located in spaced relationship with said interior face, openings defined by said support structure for receiving said springs, said springs each including spring arms adapted to engage opposite side edges of said openings, said arms being urged apart and thereby urging said interior face toward said support structure, said interior face being adapted to be pulled away from said support structure in opposition to the action of said spring arms to permit access to said speaker, and wherein said one face of said baffle lies substantially flush with the surface of said ceiling or wall.

* * * * *